US009577367B2

(12) United States Patent
Campbell et al.

(10) Patent No.: US 9,577,367 B2
(45) Date of Patent: Feb. 21, 2017

(54) SEALED CONNECTOR WITH AN EXTENDED SEAL SLEEVE AND AN ANTI-WATER POOLING RETAINER

(71) Applicant: DELPHI TECHNOLOGIES, INC., Troy, MI (US)

(72) Inventors: Jeffrey Scott Campbell, West Bloomfield, MI (US); Wesley W. Weber, Jr., Metamora, MI (US)

(73) Assignee: Delphi Technologies, Inc., Troy, MI (US)

( * ) Notice: Subject to any disclaimer, the term of this patent is extended or adjusted under 35 U.S.C. 154(b) by 71 days.

(21) Appl. No.: 14/638,387

(22) Filed: Mar. 4, 2015

(65) Prior Publication Data

US 2015/0295346 A1 Oct. 15, 2015

Related U.S. Application Data

(60) Provisional application No. 61/977,329, filed on Apr. 9, 2014.

(51) Int. Cl.
*H01R 13/52* (2006.01)

(52) U.S. Cl.
CPC ..... *H01R 13/5205* (2013.01); *H01R 13/5208* (2013.01); *H01R 13/5221* (2013.01)

(58) Field of Classification Search
CPC ..... H01R 13/5221; H01R 13/5208
USPC ..... 439/274, 275, 587, 588, 37
See application file for complete search history.

(56) References Cited

U.S. PATENT DOCUMENTS

| | | | | |
|---|---|---|---|---|
| 4,349,236 | A | 9/1982 | Guelden | |
| 6,361,342 | B1 * | 3/2002 | Cox | H01R 13/5205 277/615 |
| 7,371,115 | B1 * | 5/2008 | Hsieh | H01R 13/5208 439/271 |
| 7,632,148 | B1 | 12/2009 | Kawamura et al. | |

FOREIGN PATENT DOCUMENTS

EP 0 646 991 A1 4/1995

OTHER PUBLICATIONS

European Search Report dated Aug. 3, 2015.

* cited by examiner

*Primary Examiner* — Phuongchi T Nguyen
(74) *Attorney, Agent, or Firm* — Robert J. Myers

(57) ABSTRACT

An connector includes a terminated cable, a connector body defining a cylindrical terminal cavity configured to receive the terminated cable, and a cable seal axially surrounding a portion of the terminated cable. The cable seal defines a compliant primary sealing ring that is in compressive contact with an inner wall of the terminal cavity. The cable seal further defines an extended sleeve. The connector also includes a seal retainer that is inserted within a distal end of the terminal cavity and axially surrounds at least a portion of the extended sleeve. An inner surface of the seal retainer is proximate at least a portion of the extended sleeve and an outer surface of the seal retainer is proximate the inner wall of the terminal cavity.

13 Claims, 4 Drawing Sheets

SEALED CONNECTOR WITH AN EXTENDED SEAL SLEEVE AND AN ANTI-WATER POOLING RETAINER

CROSS-REFERENCE TO RELATED APPLICATION

This application claims the benefit under 35 U.S.C. §119 (e) of U.S. Provisional Patent Application No. 61/977,329 filed Apr. 9, 2014, the entire disclosure of which is hereby incorporated herein by reference.

TECHNICAL FIELD OF THE INVENTION

The invention generally relates to a sealed connector, and more particularly relates to a connector having a seal with an extended sleeve and a seal retainer configured to dampen vibration of a cable and inhibit retention of water within the connector.

BACKGROUND OF THE INVENTION

Cable-to-cable and cable-to-device sealed electrical connectors are subject to performance issues caused by vibration, motion, and routing of large, heavy, stiff cables (e.g. cables with a cross section greater than 6 $mm^2$). Cable seals used in electrical connectors for large cross section cables can lose sealing compression when cables are moved or routed away extreme angles. Prior art connectors have incorporated plastic retainers which limit cable motion at the cable seal. However, these retainers fit loosely on the cable insulation in order to accommodate various sizes of cable. These loose fitting retainers allow cable vibration to be readily transmitted into the electrical connector terminal causing electrical contact fretting corrosion and/or wear, leading to failure of that electrical connection. Additionally, the prior art connectors usually include an extended connector body terminal tower in order to fully capture the cable seal within its length and allow for insertion of a loose fitting seal/cable retainer. Water from the environment can collect in the terminal tower in the spaces between the seal and the end of the terminal tower. This water can then leak past the seal and cause corrosion of the terminal or cause damage to the connector if the water freezes.

Typically, a loose plastic retainer is used to limit cable motion to maintain sealing performance, but vibration performance is poor, and water can pool in the connector terminal cavity causing cable seal failure. Other previous solutions have included cable seals with insert molded plastic stiffeners, these seals are very expensive, while providing strain relief and vibration dampening of the cable, they do not completely block water pooling in the terminal cavity.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

In accordance with one embodiment of this invention, an electrical connector is provided. The connector includes a terminated cable, a connector body defining a cylindrical terminal cavity configured to receive the terminated cable, and a cable seal axially surrounding a portion of the terminated cable. The cable seal defines a compliant primary sealing ring that is in compressive contact with an inner wall of the terminal cavity. The cable seal further defines an extended sleeve. The connector also includes a seal retainer that is inserted within a distal end of the terminal cavity and axially surrounds at least a portion of the extended sleeve. An inner surface of the seal retainer is proximate at least a portion of the extended sleeve and an outer surface of the seal retainer is proximate the inner wall of the terminal cavity.

The extended sleeve may also define a compliant secondary sealing ring that is in compressive contact with the inner surface of the seal retainer. A distal end of the seal retainer may define a flange having an outside diameter that is larger than an inside diameter of the terminal cavity.

A side wall of the seal retainer and the flange of the seal retainer may be split. In this case, a portion of the flange opposite the split defines a gap that allows the seal retainer to flex and be laterally placed over the terminated cable.

The retainer may substantially fill the volume of the space within the terminal cavity from the cable seal to the distal end of the terminal cavity. The retainer may provide cable motion strain relief and maintain compression between the cable seal and the cavity inner wall.

Further features and advantages of the invention will appear more clearly on a reading of the following detailed description of the preferred embodiment of the invention, which is given by way of non-limiting example only and with reference to the accompanying drawings.

BRIEF DESCRIPTION OF THE SEVERAL VIEWS OF THE DRAWING

The present invention will now be described, by way of example with reference to the accompanying drawings, in which.

DETAILED DESCRIPTION OF THE INVENTION

A connector that includes a connector body, terminated cables, individual cable seals surrounding each terminated cable, and seal retainers configured to secure the cable seals within the connector body is presented herein. Each cable seal includes a sleeve that covers the cable from the sealing ring of the cable seal to a point on the cable near the end of the terminal cavity. The seal retainer is fitted over the sleeve, substantially filling the volume between the sleeve and the inner wall of the terminal cavity, providing cable motion strain relief, maintaining compression between the cable seal and the cavity inner wall, and preventing water from collecting within the terminal cavity. As used herein, substantially filling means that the seal retainer occupies at least ninety percent of the volume between the sleeve and the inner wall of the terminal cavity.

Figure 1:
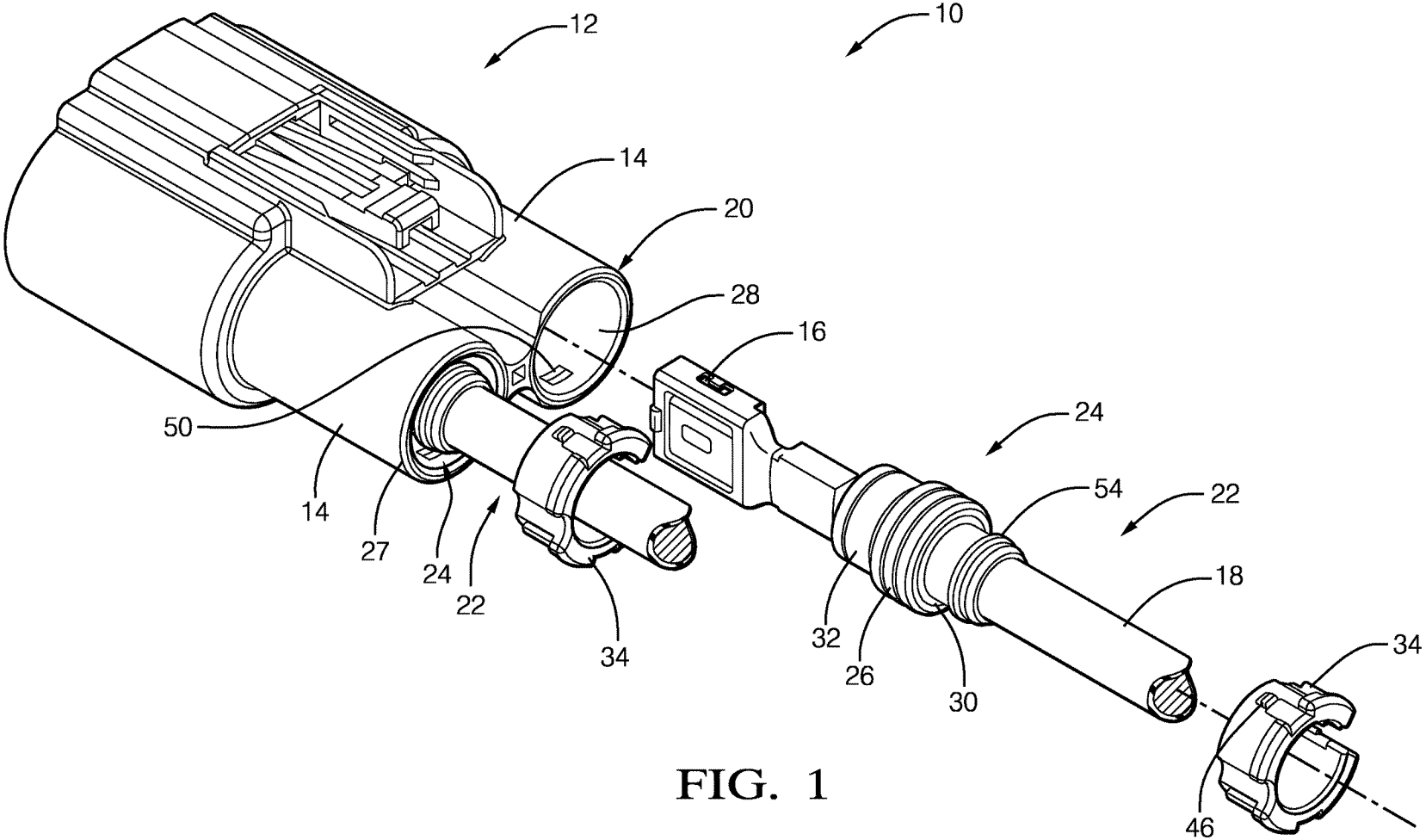
FIG. 1 is an exploded perspective view of a connector having a cable seal and a seal retainer in accordance with one embodiment.

FIG. 1 illustrates a non-limiting example of a connector 10. The connector 10 includes a connector body 12 having a plurality of terminal towers 14 each configured to accommodate a terminal 16 attached to a wire cable 18. The connector body 12 is formed of a dielectric material, such as glass-filled polyamide (PA) or polybutylene terephthalate (PBT). Each terminal tower 14 defines a substantially cylindrical terminal cavity 20 that is configured to receive and retain the terminated cable 22.

Each terminated cable 22 includes a cable seal 24 that axially surrounds a portion of the terminated cable 22. The cable seal 24 is made of a compliant material, such as a silicone rubber. The cable seal 24 defines a compliant primary sealing ring 26 that is configured to be in compressive contact with an inner wall 28 of the terminal cavity 20. As used herein, compressive contact produces a reaction force between the primary sealing ring 26 and the inner wall 28 of the terminal cavity 20. The primary sealing ring 26 is designed to block water or other environmental contaminants from reaching the terminal 16. The cable seal 24 also defines a sleeve 30 that axially extends along the wire cable 18 from the primary sealing ring 26 to a point near the distal end 27 of the terminal tower 14. As shown in the illustrated embodiment, the cable seal 24 may be attached to the terminated cable 22 by a pair of crimping wings 32 on the terminal 16 that surround and retain the cable seal 24.

Figure 4:
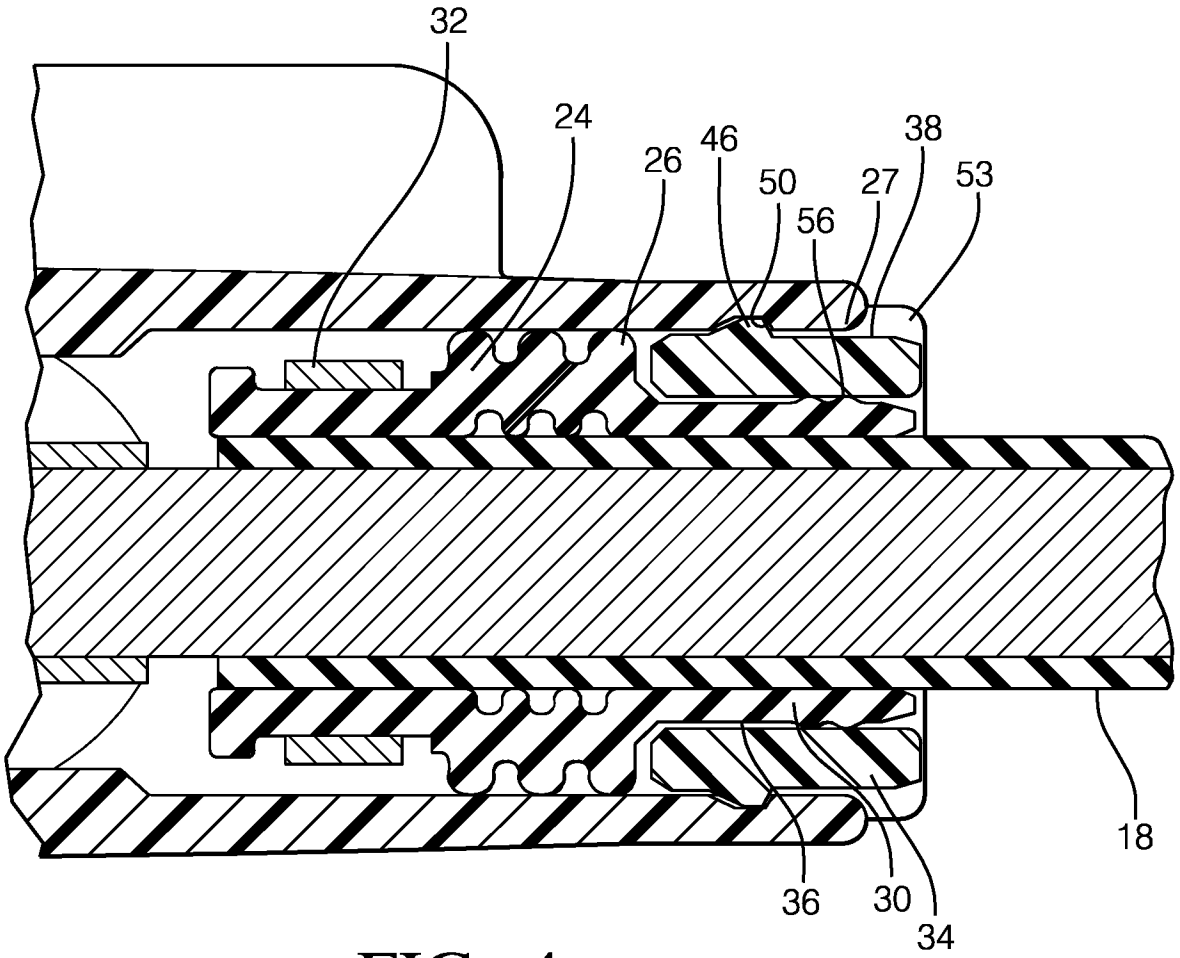
FIG. 4 is a side cross-sectional view of the connector of FIG. 3 in accordance with one embodiment.
Figure 5:
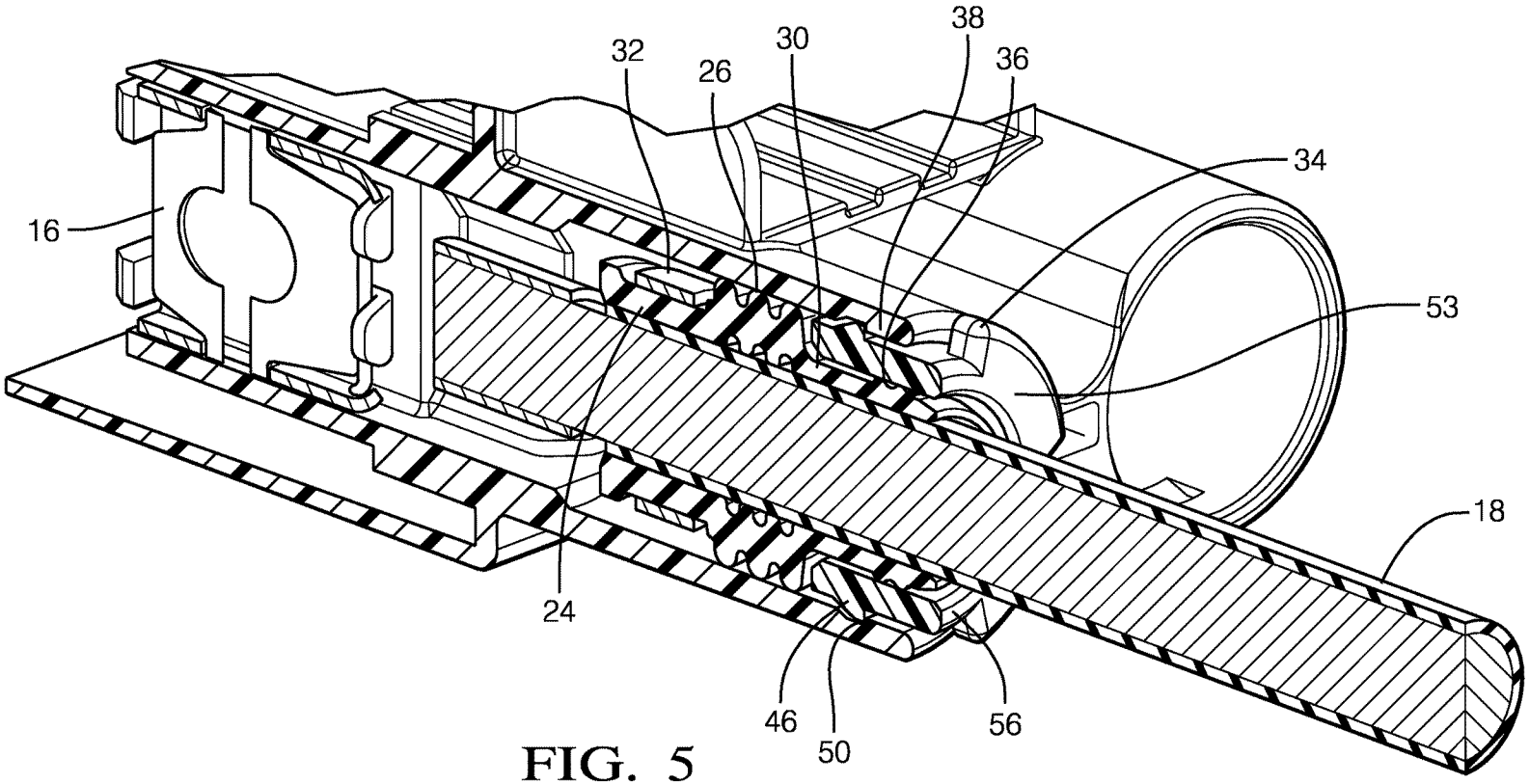
FIG. 5 is a perspective cross-sectional view of the connector of FIG. 3 in accordance with one embodiment.

The connector 10 further includes a seal retainer 34 that is configured to secure the cable seal 24 within the terminal cavity 20. The seal retainer 34 also provides strain relief for the terminated cable 22. The seal retainer 34 axially surrounds at least a portion of the sleeve 30 of the cable seal 24. The seal retainer 34 is formed of a dielectric material such as PA, PBT, or polypropylene (PP). As shown in FIGS. 4 and 5, the seal retainer 34 is designed to closely fit within the space within the terminal cavity between the cable seal and the distal end 27 of the terminal cavity 20, thereby substantially filling the volume of that space. The inner surface 36 of the seal retainer 34 is in intimate contact or nearly in intimate contact with at least a portion of the sleeve 30 and an outer surface 38 of the seal retainer 34 is in intimate contact or nearly in intimate contact the inner wall 28 of the terminal cavity 20. Filling the space between the sealing ring, sleeve 30, and inner wall 28 of the terminal cavity greatly reduces the amount of water than can collect in the unsealed portion of the terminal cavity 20 that could leak past the sealing ring and cause corrosion of the terminal 16 and when the water freezes within the terminal cavity 20, crack the connector body 12 or force the primary sealing ring 26 out of position.

Figure 2:
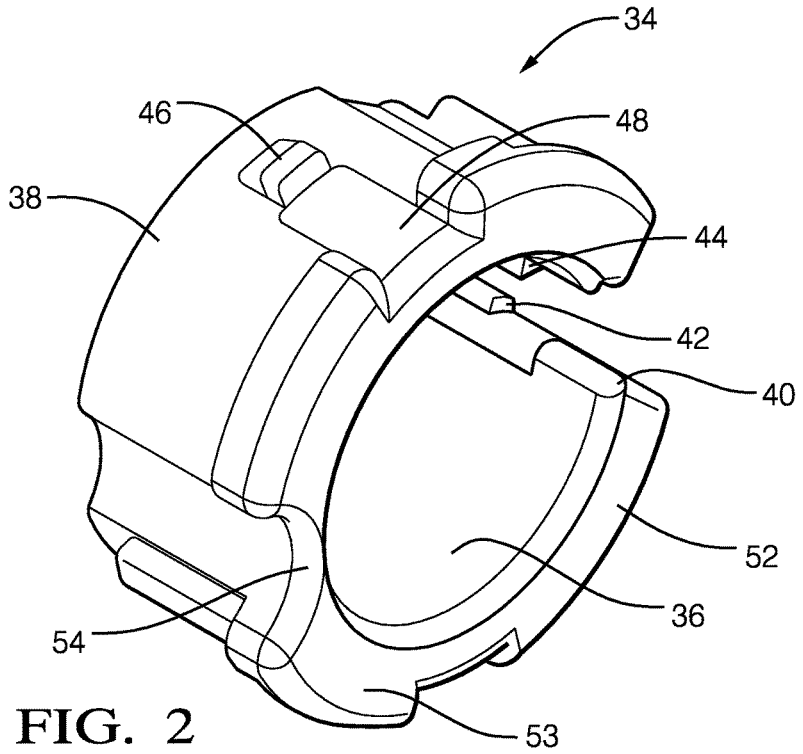
FIG. 2 is a perspective view of the seal retainer of FIG. 1 in accordance with one embodiment.
Figure 3:
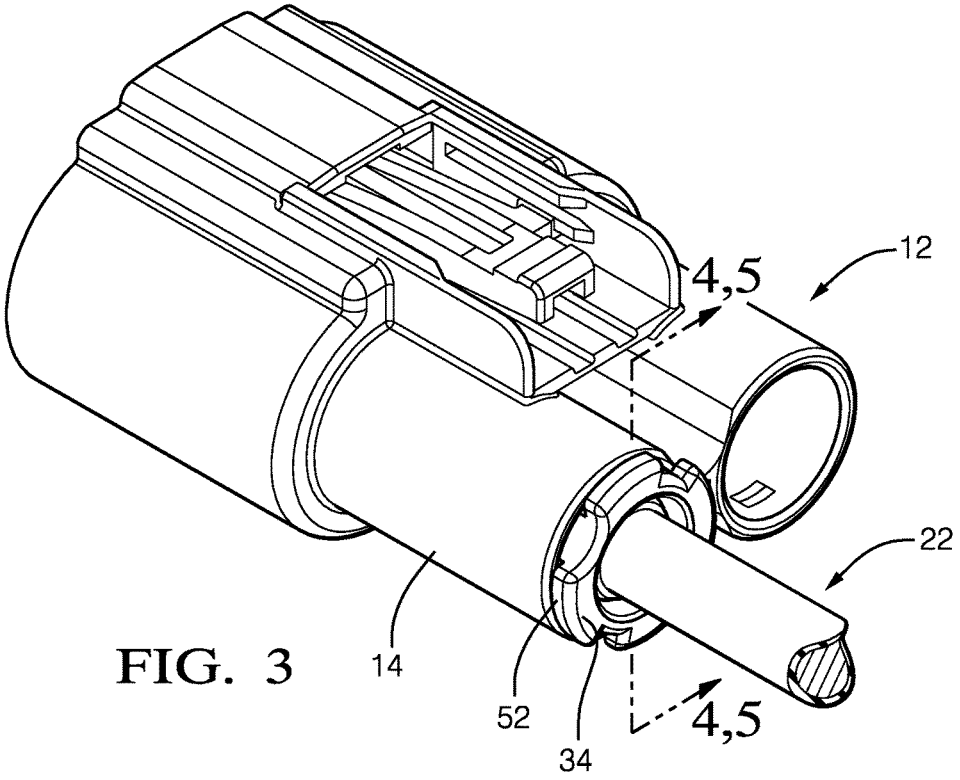
FIG. 3 is a perspective view of the seal retainer of FIG. 1 in an assembled condition in accordance with one embodiment.

As illustrated in FIG. 2, the seal retainer 34 is split along a side wall 40 of the ring so that it can be placed on the wire cable 18 laterally rather than slid over a cut end as would be required if the seal retainer were not split. This provides the benefit of simplifying the assembly process. The split side wall 40 has a tongue 42 on one side of the split and a groove 44 on the other to stabilize the side wall 40 when the split portion is joined. The seal retainer 34 defines snap features that cooperate with corresponding snap features on the connector body 12. According to the illustrated embodiments, the seal retainer 34 defines a locking nib 46 on a resilient cantilever beam 48 that engages an indentation 50 in the inner wall 28 of the terminal cavity 20. Other embodiments of the seal retainer may be envisioned using external snap features or threaded features to secure the seal retainer to the connector body. The seal retainer 34 also defines a flange 52 on the distal end 53 of the seal retainer 34. The flange 52 cooperates with the distal end 27 of the terminal tower 14 to locate the locking nib 46 and indentation 50 relative to one another. The flange 52 has an outer diameter that is greater than the inner diameter of the terminal tower 14 cavity, preventing the seal retainer 34 from fully entering the terminal cavity 20. The flange 52 has a gap 54 opposite the split in the side wall 40 of the flange 52 to allow the seal retainer 34 to flex more easily when it is placed over the wire cable 18. The flange 52 may fit flush against the distal end 27 of the terminal tower 14 to provide an initial barrier against fluid intrusion as illustrated in FIG. 3.

As shown in FIGS. 4 and 5, the sleeve 30 defines a compliant secondary sealing ring 56 that is configured to be in compressive contact with the inner surface 36 of the seal retainer 34. As used herein, compressive contact produces a reaction force between the secondary sealing ring 56 and the inner surface 36 of the seal retainer 34. Rather than being designed to seal against water intrusion, the secondary sealing ring 56 is configured to dampen vibration between the terminated cable 22 and the connector body 12.

The cable seal 24 and seal retainer 34 may be designed so that one seal retainer 34 may be used with terminated cables 22 having differing cable diameters. The outer diameter of the cable seal 24 remains the same for every different cable diameter while only the inner diameter of the cable seal 24 is changed to accommodate the cable diameter. This provides the benefit of eliminating different seal retainers 34 to accommodate different cable diameters.

The examples presented herein are directed to electrical connectors, however other embodiments of the connector 10 may be envisioned that are adapted for use with optical cables or hybrid connectors including both electrical cables and optical cable connections. Yet other embodiments of the connector may be envisioned that are configured to interconnect pneumatic or hydraulic lines.

Accordingly, a connector 10 with improved sealing capabilities is provided. The cable seals 24 cooperate with the seal retainers 34 to provide vibration dampening and strain relief for the terminated cables 22. The cable seals 24 and the seal retainers 34 also cooperate to minimize the volume of water than can collect in the unsealed portions of the terminal towers 14. The cable seals 24 and the seal retainers 34 further provide the benefit of accommodating a wide range of cable sizes.

While this invention has been described in terms of the preferred embodiments thereof, it is not intended to be so limited, but rather only to the extent set forth in the claims that follow. Moreover, the use of the terms first, second, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector, comprising:

a terminated cable;

a connector body defining a terminal cavity configured to receive the terminated cable;

a cable seal axially surrounding a portion of the terminated cable, said cable seal defining a compliant primary sealing ring in compressive contact with an inner wall of the terminal cavity, said cable seal further defining an extended sleeve; and a seal retainer inserted within a distal end of the terminal cavity and axially surrounding at least a portion of the extended sleeve, wherein a side wall of the seal retainer is longitudinally split allowing the seal retainer to be laterally placed onto the terminated cable and wherein an inner surface of the seal retainer is proximate the at least a portion of the extended sleeve and an outer surface of the seal retainer is proximate the inner wall of the terminal cavity, wherein the side wall defines a tongue on one side of the split and a groove on the other side of the split configured to receive the tongue, wherein the tongue and groove cooperate to stabilize the side wall when the split portion is joined.

2. The connector in accordance with claim 1, wherein the extended sleeve defines a compliant secondary sealing ring in compressive contact with the inner surface of the seal retainer.

3. The connector in accordance with claim 1, wherein the retainer substantially fills the volume of the space within the terminal cavity from the cable seal to the distal end of the terminal cavity.

4. The connector in accordance with claim 1, wherein the retainer provides cable motion strain relief and maintains compression between the cable seal and the cavity inner wall.

5. The connector in accordance with claim 1, wherein a distal end of the seal retainer defines a flange having an outside diameter larger than an inside diameter of the terminal cavity.

6. The connector in accordance with claim 5, wherein the flange of the seal retainer is also split and wherein a portion of the flange opposite the split defines a gap allowing the seal retainer to flex as it is laterally placed over the terminated cable.

7. A connector, comprising:

a terminated cable;

a connector body defining a terminal cavity configured to receive the terminated cable;

a cable seal axially surrounding a portion of the terminated cable, said cable seal defining a compliant primary sealing ring in compressive contact with an inner wall of the terminal cavity, said cable seal further defining an extended sleeve; and a seal retainer inserted within a distal end of the terminal cavity and axially surrounding at least a portion of the extended sleeve, wherein a side wall of the seal retainer is longitudinally split allowing the seal retainer to be laterally placed onto the terminated cable and wherein an inner surface of the seal retainer is proximate the at least a portion of the extended sleeve and an outer surface of the seal retainer is proximate the inner wall of the terminal cavity, wherein the seal retainer defines a locking nib on a resilient cantilever beam that is configured to engage an indentation in the inner wall of the terminal cavity, thereby retaining the seal retainer within the terminal cavity.

8. The connector in accordance with claim 7, wherein the connector body defines a cylindrical terminal tower containing the terminal cavity and wherein the flange cooperates with a distal end of the terminal tower to locate the locking nib and indentation relative to one another.

9. The connector in accordance with claim 7, wherein the extended sleeve defines a compliant secondary sealing ring in compressive contact with the inner surface of the seal retainer.

10. The connector in accordance with claim 7, wherein the retainer substantially fills the volume of the space within the terminal cavity from the cable seal to the distal end of the terminal cavity.

11. The connector in accordance with claim 7, wherein the retainer provides cable motion strain relief and maintains compression between the cable seal and the cavity inner wall.

12. The connector in accordance with claim 7, wherein a distal end of the seal retainer defines a flange having an outside diameter larger than an inside diameter of the terminal cavity.

13. The connector in accordance with claim 12, wherein the flange of the seal retainer is also split and wherein a portion of the flange opposite the split defines a gap allowing the seal retainer to flex as it is laterally placed over the terminated cable.

* * * * *